US005947634A

United States Patent [19]

Robillard

[11] Patent Number: 5,947,634

[45] Date of Patent: Sep. 7, 1999

[54] METHOD OF POTHOLE REPAIR

[76] Inventor: Gary L Robillard, P.O. Box 221, L'Anse, Mich. 49946

[21] Appl. No.: 08/955,221

[22] Filed: Oct. 22, 1997

[51] Int. Cl.[6] ..... E01C 5/08; E01C 7/06; E01C 7/32; E01C 19/00

[52] U.S. Cl. ..... 404/70; 404/17; 404/82; 404/75

[58] Field of Search ..... 404/73, 74, 75, 404/28, 31, 50, 51, 53, 55, 56, 70, 82; 52/295, 742.1, 742.13

[56] References Cited

U.S. PATENT DOCUMENTS

| | | | |
|---|---|---|---|
| 4,431,335 | 2/1984 | Evans | 404/75 |
| 4,556,338 | 12/1985 | Fahey | 404/28 |
| 4,701,070 | 10/1987 | Jelling | 404/75 |
| 4,781,490 | 11/1988 | Jelling | 404/75 |
| 5,660,498 | 8/1997 | Freeman | 404/17 |
| 5,749,674 | 5/1998 | Wilson, Sr. | 404/75 |
| 5,829,914 | 11/1998 | Wells | 404/73 |

*Primary Examiner*—Thomas B. Will
*Assistant Examiner*—Gary S. Hartmann
*Attorney, Agent, or Firm*—Thomas J. Tighe

[57] ABSTRACT

A method of installing a patch in a pothole in a paved road including the steps of (1) undercutting the edges of the pavement defining the pothole to a uniform angle from the vertical; (2) excavating a portion of substratum beneath the pavement to undercut the pavement around the pothole, both undercuttings to increase the size of the patch's footing; (3) lining the undercut with a layer of filler material and tamping; (4) inserting an underlining wire mesh fitted to reach into the undercut beneath the pavement; (5) inserting and tamping additional filler material to an intermediate level of the pothole; (6) inserting a second wire mesh preferably fitted to the periphery of the pothole at the intermediate level; (7) around the periphery of the pothole spacing and anchoring a plurality support dowels into the undercut pavement edges at about the intermediate level; and (8) filling and tamping the pothole level with existing pavement surface.

13 Claims, 1 Drawing Sheet

METHOD OF POTHOLE REPAIR

BACKGROUND OF THE INVENTION

This invention relates in general to methods of repairing potholes in roadways, e.g. asphalt and concrete roads, and more particularly to such methods which repair the holes by filling them with repair material.

Potholes in roadways have always been a problem, and many methods have been tried to fill them. The simplest method has been to just fill the hole with repair material, such as asphalt, but it soon became obvious that anchors were needed to extend the life of a repaired pothole. Various combinations of mesh and/or anchoring dowels have been used for this purpose. In some cases, an undercutting method was used as an anchor. By allowing filler material to flow under the existing road surface the filler material itself can become a useful anchor.

Of all the methods used hitherto, one type of natural anchor has been overlooked. Most potholes require some preparation of the existing road surfaces, usually involving some shaping or cutting. Also, anchoring seems to be an important factor in the durability of a repaired pothole, especially to repairs exposed to frost heave. Yet, despite these facts, no method studied has considered a way to use the nature of a properly prepared edge as a free (i.e. no material cost) and powerful auxiliary anchoring method.

The method of this invention provides a quick, inexpensive and lasting repair for all potholes. The repair time per pothole is approximately five minutes using standard road working equipment and materials. Special design considerations are incorporated to address heavy loads (e.g. loads of 160,000 lbs.) and the problem imposed by frost action that occurs to roads exposed to northern climate conditions.

Other advantages and attributes will be seen from a reading of the text hereinafter.

SUMMARY OF THE INVENTION

It is an object of the invention to provide a method which yields a quick, inexpensive and lasting pothole repair.

It is another object of the invention to provide a method of pothole repair which uses standard road working equipment and materials.

It is another object of the invention to provide a method of pothole repair which anchors the fill material to the existing roadway.

It is another object of the invention to provide a method of pothole repair applicable to a variety of road pavements, including asphalt and concrete.

It is another object of the invention to provide a method of pothole repair which can be used in a variety of hard surfaces such as roadways, garage slabs, tennis courts, and some vertical structures.

These objects, and other objects expressed or implied in this document, are accomplished by an inventive method of pothole repair which uses standard road working equipment and materials, and includes undercutting the pothole edge at a generally 30 degree angle to a depth below the bottom of the usable pavement, preferably about one inch below the pavement. Then fill material is tamped into the pothole to preferably about one-half inch below the pavement. Then a sized piece of three-sixteenth inch by four inch wire mesh is then placed in the hole upon the tamped fill, the size being such that margins of the mesh lie under the pavement around the periphery of the pothole. More fill is then added on top of the mesh and tamped until the pothole is about one-half full. A second sheet of three-sixteenth inch by four inch wire mesh is then placed atop of the tamped fill. One-quarter inch by three inch mild steel or nylon dowel pins are then anchored into the pavement around the periphery of the pothole, preferably two inches below and parallel with the road surface, spaced preferably six inches apart. More fill is then added and tamped until the tamped fill is up to the level of road surface. The method is applicable to the repair of road pavements including asphalt and concrete; as well as a variety of hard surfaces such as roadways, garage slabs, tennis courts, and some vertical structures. Special design considerations in this method of pothole repair have been addressed for heavy loads of 160,000 pounds and the stresses associated with frost heave common in northern climates.

DESCRIPTION OF THE PREFERRED EMBODIMENT

Figure 1:
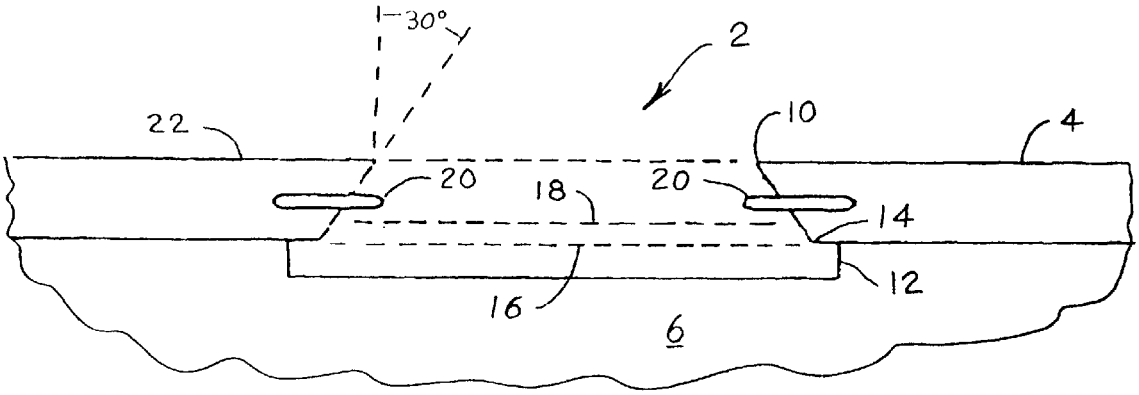
FIG. 1 is a cross-section of a vertical plane through a pothole defined in a roadway, the pothole having been prepared according to the method of the invention.

Referring to the figures, a cross-section of a pothole, generally designated 2, in a typical pavement 4 is illustrated. Below the pavement is a substratum 6 which can be, e.g., dirt, aggregate, or a lower layer of pavement. According to this invention, the first step is to prepare an undercutting edge in the pavement around the pothole. This is preferably done by cutting the pothole edges 10 to a generally uniform angle from the vertical, preferably 30°. The undercutting angle can be prepared with simple hand tools for soft pavement, e.g. asphalt, or with air tools for hard pavement, e.g. concrete. Once the undercutting edge is prepared, a small (approximately 1.0" deep) undercut 12 is dug into the substratum 6 under the pavement 4 around the pothole. The undercut extends laterally under the pavement preferably one-half inch beyond the lower edges 14 of the pavement. The next step is to tamp a layer of filler material (not shown) into the bottom of the prepared pothole (approximately one-half inch). The next step is to shape a piece of wire mesh 16 (preferably 3/16"×4") so that it will fit both in the bottom of the pothole and under the pavement. In other words, the wire mesh is placed on top of the tamped fill material with its edges extending laterally under the lower edges of the pavement 14. The next step is to add additional filler material and tamp it to about half the prepared pothole's total depth. A second piece of wire mesh 18 is then shaped to fit into the half-filled pothole and placed therein on top of the tamped fill. The second mesh's edges should extend to the undercut edges of the pothole, laterally beyond the upper edge 10.

Referring again to the figures, the next step is to anchor a plurality of generally radially oriented pins 20 into the undercut edges of the pothole at a depth just above the second wire mesh 18, spaced about six inches apart, and parallel to the pavement surface 22. As illustrated, the pins are preferably ¼" by 3" nylon or steel dowels, however the length depends on material type and pothole size, three inches being nominal. The support dowels are generally driven or drilled into the pavement approximately two-thirds of their total length to achieve adequate anchoring and support. For example, three inch dowels preferably are anchored two inches into the pavement leaving one inch to protrude into the pothole.

Figure 2:
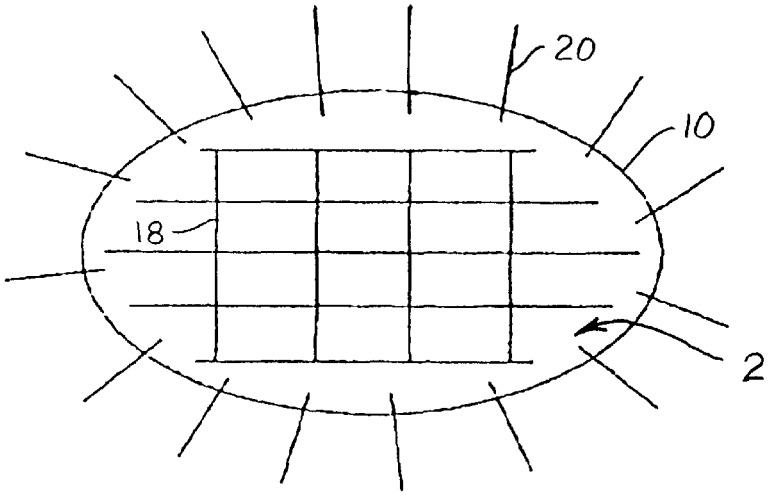
FIG. 2 is a schematical representation of a stage of pothole repair according to this invention.

FIG. 2 illustrates this dowel-placement stage of the method schematically showing distribution of the dowels and the second mesh 18 (not to scale) atop the tamped fill in the pothole 2. (The first layer of mesh 16 is not shown in for clarity.) Also, it is understood that the edges of the mesh 18 extend laterally beneath the dowels and beyond the upper pothole edge 10, but is not shown doing so in FIG. 2 for clarity.

The final step is to fill the remainder of the pothole with filler material and tamp it flush with the top surface 22 of the pavement 6.

Referring again to the figures, the method of this invention satisfies the two basic needs of any pothole repair: (1) distribution of top surface forces and (2) distribution of underside forces. Parallel forces are distributed by dowels anchored into the edges of the pavement around the pothole. Downward forces are distributed by the dual layer of reinforcement mesh, 16 and 18, combined with an enlarged pothole patch footing that transmits, or grounds downward forces away from the still usable pavement. Finally, underside forces (e.g. frost heaves that tend to pucker a pothole resulting in failure) are hindered primarily by the approximate 30 degree angle undercutting of the edges 10 of the pothole. Upward forces that would typically split the seam of an ordinary pothole patch actually have a positive effect by tightening the seam between the patch and the existing pavement. A frost heave may heave the road, but after the thaw a patch according to this invention will still be in its proper place. Most roads will not carry traffic above 160,000 pounds and not all roads experience frost heave, which is considered the most destructive of the natural forces vis-a-vis roads. However, force distribution tests on this method were preformed under both of these extreme conditions.

A major advantage of this method is its use of the uniform undercutting angle that acts as a very powerful anchor which adds no extra material cost to the repair. This "built-in" anchor has allowed the test potholes repaired by this method to withstand extreme loads (160,00 lbs.) under the most adverse road conditions (spring frost heaves). A test pothole repair was done according to this method on Apr. 16, 1996 and is still in service as of Sep. 9, 1998, while previous repairs on the same pothole by other methods had disintegrated within a year.

The foregoing description and drawing were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the method of this invention can just as easily be used to repair voids in the hard surfaces of garages, driveways, sidewalks, tennis courts or other arenas of play.

What is claimed is:

1. A method of repairing potholes found along road surfaces, comprising the following steps:

(a) undercutting edges of pavement defining the pothole to a uniform angle from vertical;

(b) excavating a portion of substratum beneath the pavement to undercut the pavement around the pothole, both undercuttings to increase a footing size for a patch;

(c) lining the undercut with a layer of filler material and tamping;

(d) inserting a first wire mesh fitted to reach into the undercut beneath the pavement;

(e) inserting and tamping additional filler material to an intermediate level of the pothole;

(f) inserting a second wire mesh fitted to a periphery of the pothole at the intermediate level;

(g) around the periphery of the pothole spacing and anchoring a plurality support dowels into the undercut pavement edges at about the intermediate level; and (h) filling and tamping the pothole level with existing pavement surface.

2. The method of claim 1 in which the road surface is concrete pavement.

3. The method of claim 1 in which the dowel pins are nylon.

4. The method of claim 1 in which the angle is approximately 30 degrees.

5. The method of claim 1 in which the undercutting extends laterally beyond the bottom edge of the pavement approximately one-half inch.

6. The method of claim 1 in which the dowels are anchored in a generally radial direction around the edge of the pothole.

7. The method of claim 6 in which the dowels are spaced apart approximately 6 inches.

8. A method of repairing potholes found along road surfaces, comprising the following steps:

(a) undercutting the pothole edge at a 30 degree angle to approximately one inch below usable road surface;

(b) tamp approximately ½ inch fill material into pothole;

(c) place sized 3/16"×4" wire mesh on top of tamped fill and under the usable road surface;

(d) fill the pothole to ½ full and tamp;

(e) embed sized 3/16"×4" wire mesh;

(f) drive or drill anchor pins of ¼"×3" mild steel or nylon dowels at a depth of 2" into and parallel to the road surface, spaced 6" apart; and (g) fill level with the road surface.

9. The method according to claim 8 in which the road surface is asphalt pavement.

10. The method according to claim 8 in which the dowel pins are mild steel.

11. The method according to claim 8 in which wire mesh is 3/16"×4" mild steel reinforcement material.

12. The method according to claim 8 wherein which the road surface is concrete pavement.

13. The method of claim 8 wherein the dowel pins are nylon.

* * * * *